US005943964A

United States Patent [19]

Downes et al.

[11] Patent Number: 5,943,964

[45] Date of Patent: Aug. 31, 1999

[54] LIGHT WEIGHT DRAFT ARM

[75] Inventors: John R. Downes, Columbus; Todd W. Stecker, Canal Winchester, both of Ohio

[73] Assignee: Buckeye Steel Castings, Columbus, Ohio

[21] Appl. No.: 09/040,689

[22] Filed: Mar. 18, 1998

[51] Int. Cl.[6] ..... B61F 1/00

[52] U.S. Cl. ..... 105/420

[58] Field of Search ..... 105/3, 4.1, 4.2, 105/199.4, 416, 420, 421; 213/10, 62 R, 69, 62 A, 75 R

[56] References Cited

U.S. PATENT DOCUMENTS

| | | | |
|---|---|---|---|
| 2,902,947 | 9/1959 | Lich | 105/420 |
| 3,561,370 | 2/1971 | Reynolds | 105/420 |
| 3,677,198 | 7/1972 | Yang et al. | 105/420 |
| 3,703,239 | 11/1972 | Furniss | 105/199.4 |
| 4,029,022 | 6/1977 | McClurg | 105/420 |
| 4,042,117 | 8/1977 | McClurg | 213/50.5 |
| 4,112,851 | 9/1978 | Rousseau et al. | 105/199.4 |
| 4,128,062 | 12/1978 | Roberts | 105/420 |
| 4,130,068 | 12/1978 | Stark et al. | 105/420 |
| 4,213,400 | 7/1980 | Snyder et al. | 105/199.4 |
| 4,252,068 | 2/1981 | Nolan | 105/199.4 |

*Primary Examiner*—Mark T. Le
*Attorney, Agent, or Firm*—Banner & Witcoff, Ltd.

[57] ABSTRACT

A light weight draft arm is provided for use in a railway car. The draft arm includes a center plate with a significant amount of material removed and lateral support members inboard and outboard of the center plate transversing the side walls. Removal of the material around the center plate along with the addition of the lateral support members decreases the overall weight of the draft arm while still maintaining its strength. With the exception of the enhancements around the center plate, the draft arm is conventional.

12 Claims, 3 Drawing Sheets

LIGHT WEIGHT DRAFT ARM

BACKGROUND OF THE INVENTION

1. Field of the Invention

The present invention relates in general to improved draft arms for railway cars. More specifically, but without restriction to the particular use which is shown and described, this invention relates to a lighter weight draft arm.

2. Description of the Related Art

A railcar draft arm is a box-shaped member positioned between the center sill and the coupler of a railcar. A draft arm is located on each end of the center sill, which extends along the length of the railcar body, as part of the under frame; thus two draft arms are used with each railcar. The draft arms, as with the center sill, are welded to the under frame of the railcar body. The draft arms serve the multipurpose of connecting the center sill to the railcar couplers and transmitting the draft and buff (longitudinal) loads through the railcar to the next railcar. In addition, the draft arm provides the connection between the railcar body and the trucks, which support the railcar body at both ends of the railcar.

At each end of the center sill, the draft arm is fitted and welded at its inboard end to the center sill. The outboard end of the draft arm has either a cast integral striker or a separate striker assembly that is fitted with and welded to the draft arm. A coupler assembly and its associated yoke are mounted to the outboard end of the draft arm, through the opening formed by the striker. The coupler assembly and yoke are secured to the draft arm by a draft key, which extends through a pair of aligned draft arm key slots, the striker key apertures and cooperating apertures in the coupler and yoke.

In addition to the pair of aligned draft key slots which are conventionally located in each of the side walls of the draft arm, the draft arm also includes front and rear draft lugs within the draft arm, a center plate, and a single hollow kingpin hole for receiving a kingpin or bolt extending from a railway car truck. The center plate provides the connection to the center bowl on the truck bolster.

Conventionally, draft arms are manufactured of cast steel. The draft arms therefore contribute a substantial part of the total weight of the railway car. Since there are weight limits placed on shippers of goods for preserving the safety and conditions of the track, the quantity of goods that may be placed in or on a railcar is affected by the weight of the railcar body, the trucks and other railcar components. Thus, a reduction in the weight of the railway cars, including the draft arms, will result in an increase in the total capacity of goods shipped by a rail line owner. Therefore, it is highly desirable to reduce the weight in the draft arms without a decrease in strength.

SUMMARY OF THE INVENTION

Accordingly, an object of the present invention is to reduce the weight of a railway car by reducing the overall weight of the draft arms. It is another object of this invention to reduce the weight of the draft arm without a decrease in strength.

Briefly stated, the present invention involves lightening the draft arm by removing metal in the center plate around the kingpin hole and from the king pin post, and also locating support members inboard and outboard of the kingpin hole above the center plate. The support members are integral with the center plate and extend from the center plate to the approximate midpoint between the top surface and the bottom surface of the draft arm. Locating support members inboard and outboard of the kingpin hole better handle the transverse loads from the railcar body bolster more efficiently than conventional draft arms. The resulting draft arm construction is thus lighter weight than conventional draft arms and better withstands the loads from the railcar body.

The full range of objects, aspects and advantages of the invention are only appreciated by a fill reading of this specification and a full understanding of the invention. Therefore, to complete this specification, a detailed description of the invention and the preferred embodiment follows, after a brief description of the drawings.

BRIEF DESCRIPTION OF THE DRAWINGS

The preferred embodiments of the invention will be described in relation to the accompanying drawings. In the drawings, the following figures have the following general nature.

In the accompanying drawings, like reference numerals are used throughout the various figures for identical structures.

DESCRIPTION OF THE PREFERRED EMBODIMENTS

Figure 1:
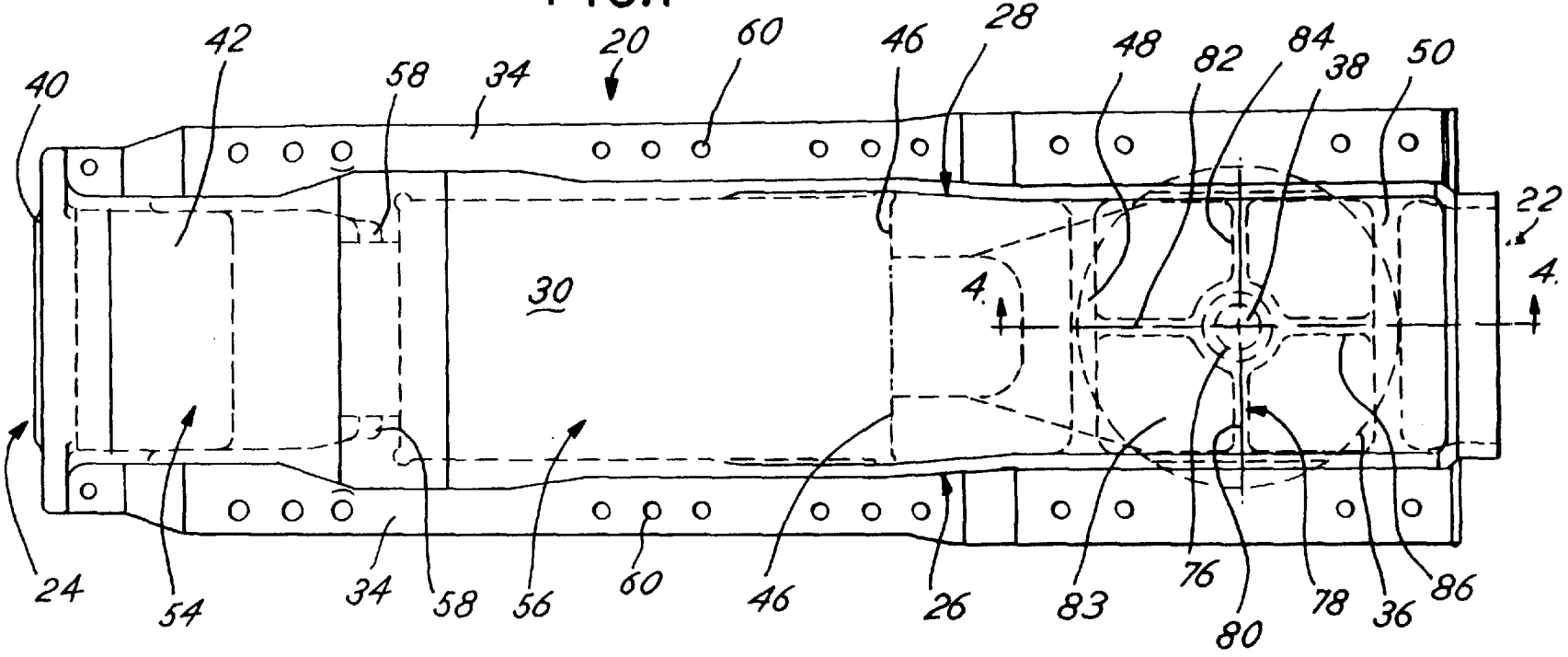
FIG. 1 is a plan view of the draft arm of the present invention.
Figure 2:
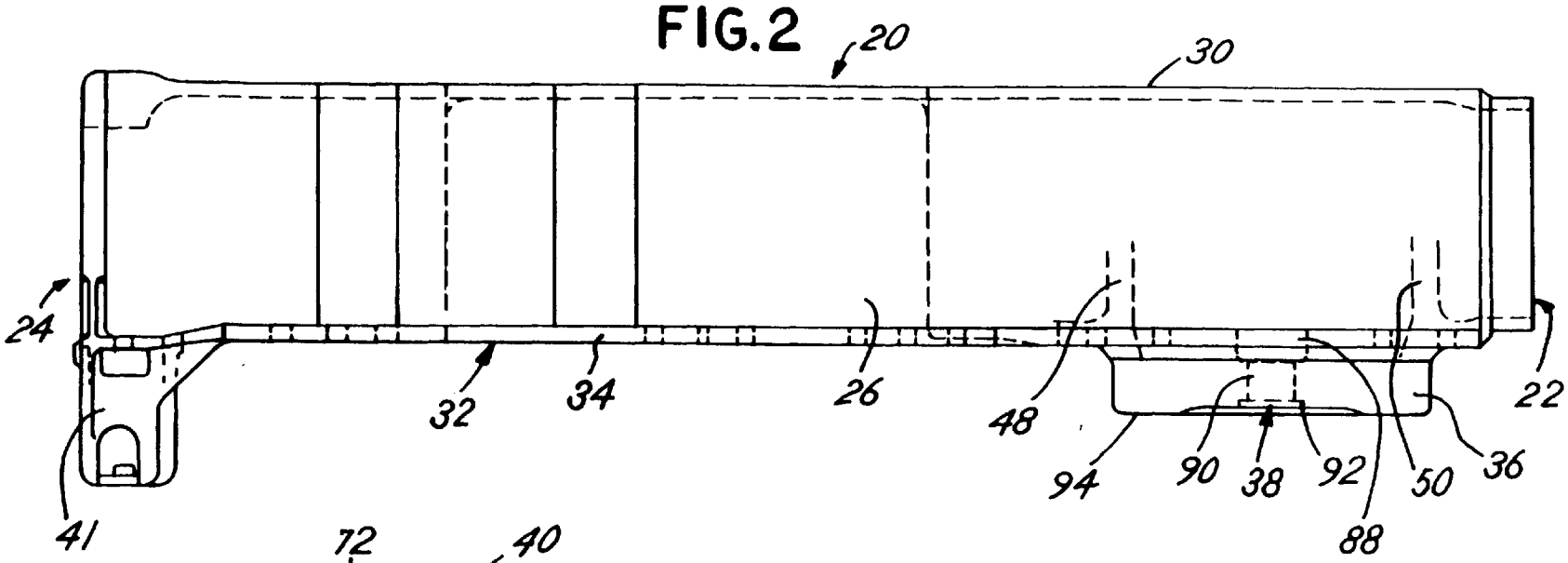
FIG. 2 is a side elevation view of the draft arm of FIG. 1.

Referring to FIG. 1, there is shown a plan view of a draft sill or draft arm 20 of the present invention. FIG. 2 illustrates the side elevation view of the draft arm 20. Referring to FIGS. 1 and 2, the draft arm 20 is cast and customarily made from a high-strength grade B steel. The draft arm 20 is predominantly a hollow elongated rectangular body generally comprising a vertical open inboard end 22 and a vertical open outboard end 24, a pair of opposing vertical side walls 26 and 28, a horizontal top surface 30 and a horizontal partially open bottom surface 32. Each of the side walls 26 and 28 terminate, along the bottom surface 32, in a lower outwardly extending flange 34 defining a plurality of mounting holes 60.

Near the inboard end 22 along the bottom surface is a center plate 36 forming a kingpin post 76 having a kingpin hole 38. The center plate 36 is mateable with the center bowl of the railcar truck bolster while the kingpin hole 38 is sized and shaped to receive a kingpin, not shown, extending from the railcar truck, thereby rotatably connecting the draft arm 20 to the railcar truck bolster. The inboard end 22 is fitted within and welded to a center sill, not shown. The outboard end 24 is either fitted with and welded to a striker assembly, not shown, or cast integral with a striker 40. Located at the outboard end 24 on the bottom surface 32 is a cast integral spring basket 41 for holding a coupler carrier assembly, not shown. In operation, as mounted and welded to the underframe of a railway car, the draft arm 20 is located between the center sill and the striker and connected to the railcar truck via the kingpin hole 38.

As conventional, the bottom surface 32 of the draft arm 20 is open having no metal layer in the draft pocket area 54 to install the draft gear, not shown. In addition, an opening 56 through the bottom surface 32 exists between the front draft lugs 58 and the rear draft lugs 46 to install the yoke, not shown. As in traditional draft arms, the remainder of the bottom surface remains closed with a metal layer.

The front draft lugs 58 aid in absorbing the buff loads of the railcars. The front draft lugs 58 are formed integral with the side walls 26 and 28 and extend out from the inner surface of the side walls 26 and 28. The front draft lugs 58 form an abutment face which in operation provide a wall to stop the longitudinal motion of the draft gear, not shown. The draft lugs 58 oppose each other from each side wall 26 and 28 and leave a gap or opening between the lugs 58 to permit the installation of the draft gear.

The rear draft lugs 46 are cast integral with the draft arm 20 and are formed out of the interior surface of the side walls 26 and 28 and also extend laterally along the bottom surface away from the interior surface of the side walls 26 and 28 toward the longitudinal axis of the draft arm 20. The rear draft lugs 46 form an abutment surface which in operation provide a wall to stop the longitudinal motion of the yoke. The rear draft lugs 46 oppose each other from each side wall 26 and 28 and leave a gap or opening between the lugs to permit the installation of the yoke.

Figure 3:
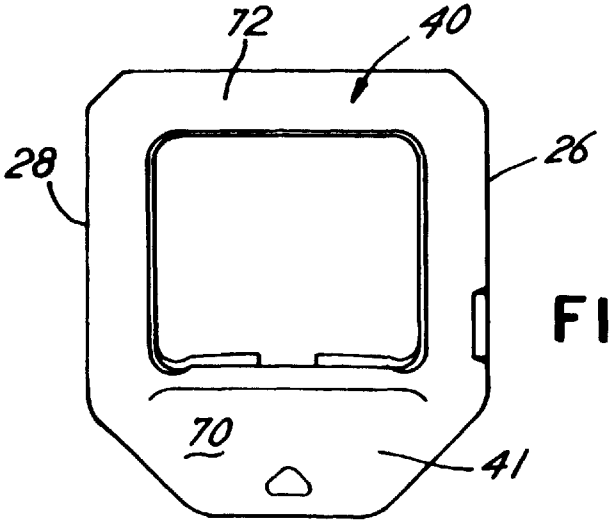
FIG. 3 is an end elevation view of the draft arm of FIG. 1.

The outboard end 24 of the draft arm 20 comprises the striker area 42. The striker area 42 may include a cast integral striker 40 or a striker assembly that is fitted with and welded to the draft arm 20. The striker 40 receives strikes from the coupler head, not shown, when the railcar goes through severe buff loading, that is, when the draft gear is bottomed out or goes through its full travel. Referring to FIG. 3, the outboard end of the striker 40 is open for receiving the coupler assembly. The lower end portions of the side walls 26 and 28 are joined by the integral spring basket 41 which serves as a coupler carrier and thus supports the coupler assembly. On the outboard end of the striker 40 is a striker face 70 formed integral with the side walls 26 and 28 and a horizontal top wall 72 of the striker 40. The striker face 70 serves as an abutment face when the striker 40 is contacted by the coupler head during severe buff loading.

As illustrated in FIG. 2, the center plate 36 is integral with the draft arm 20 along the bottom surface 32 and protrudes out from the horizontal bottom surface 32 and terminates to form the center plate surface 94 that is in parallel relation to the horizontal bottom surface 32. Note that in consonant with the spirit and scope of the present invention, the center plate 36 may be an independent plate that is welded to the bottom surface 32 of the draft arm 20.

Figure 4:
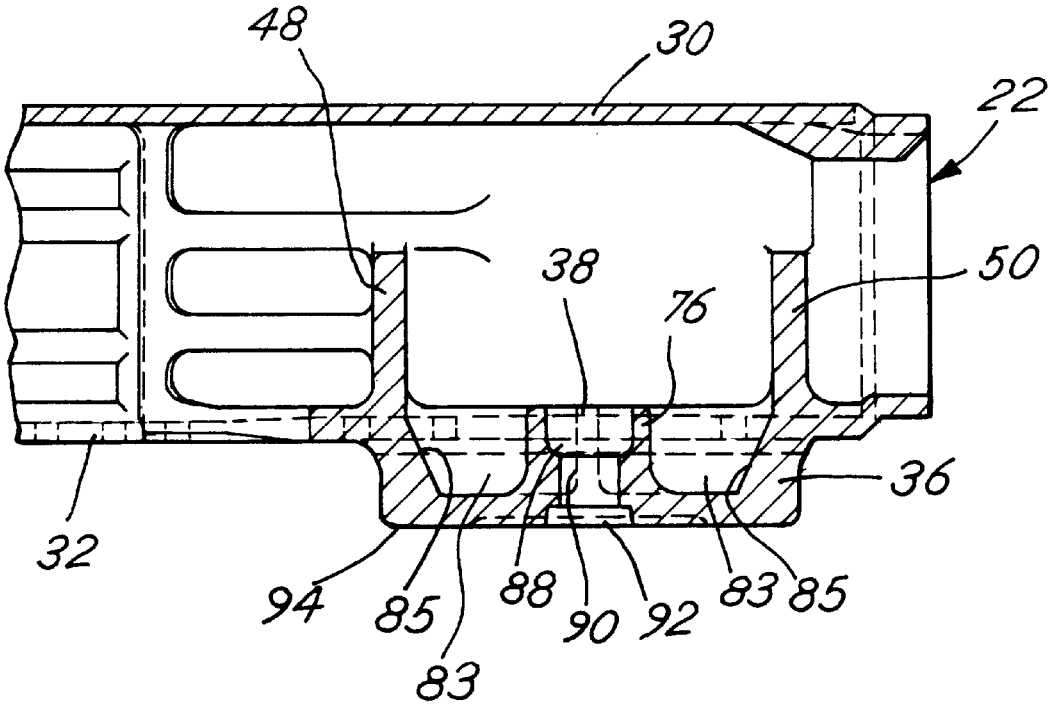
FIG. 4 is partial cross-section elevation view taken at section line 4—4 of the draft arm of FIG. 1.

Referring to FIG. 4, in a preferred embodiment, a significant portion of material is removed from the center plate 36, the kingpin post 76, and around the kingpin hole 38. For structural purposes, support members 48 and 50 are located inboard and outboard of the kingpin hole 38. The support members 48 and 50 are cast integral with the bottom surface 32 of the draft arm 20 and the side walls 26 and 28. As depicted in FIG. 1, the integral support members 48 and 50 perpendicularly extend out from and transverse the side walls 26 and 28. Referring again to FIG. 4, the support members 48 and 50 extend outward from the bottom surface 32 and the center plate 36 into the draft arm 20 to the approximate midpoint between top surface 30 and bottom surface 32. The support members 48 and 50 are designed with a thickness and length sufficient to withstand the transverse loads placed upon the center plate 36 from the railcar body and yet remain as light weight as structurally possible. In addition, the support members 48 and 50 provide not only lateral support for the draft arm 20 between the side walls 26 and 28 but also longitudinal support for the kingpin post 76 and accompanying kingpin hole 38. Preferably, the thickness of the support members 48 and 50 is 1 and ¼ inches.

Referring to FIGS. 1, 2 and 4, the center plate 36 has a circular shape and comprises the centrally positioned internal kingpin post 76 which defines the vertical kingpin hole 38. The kingpin post 76 is connected to a web 78 comprising a plurality of laterally-extending, vertically-oriented ribs 80, 82, 84, and 86 which provide sufficient longitudinal and lateral support for the kingpin post while simultaneously reducing the weight of the draft arm around the center plate. At one end, each rib integrally connects with the kingpin post 76. At the opposite end, ribs 80 and 84 integrally connect with the side walls 26 and 28, and ribs 82 and 86 integrally connect with the support members 48 and 50. Between each of the ribs are pockets 83 formed by the ribs, the kingpin post 76, and the center plate inner wall 85.

Referring to FIGS. 2 and 4, the kingpin hole 38 includes an upper cylindrical section 88 centrally positioned within the kingpin post 76. The upper cylindrical section 88 of the kingpin post 76 extends and terminates at the same plane formed by the lower surface 32 of the draft arm 20. The kingpin hole 38 further includes a middle cylindrical section 90 coaxially positioned with and of slightly smaller diameter than the upper cylindrical section 88. The kingpin hole 38 still further includes a lower cylindrical section 92 coaxially positioned with and of slightly greater diameter than the middle cylindrical section 90. The bottom cylindrical section 92 of the kingpin hole 38 extends to the center plate surface 94.

Significantly, the elimination of material from the center plate over traditional draft arms decreases the weight of the draft arm while the support members 48 and 50 maintain the strength of the draft arm. This decrease in draft arm weight while maintaining constant draft arm strength provides for an increase in the amount of lading carried by railway cars.

The preferred embodiments of the invention are now described as to enable a person of ordinary skill in the art to make and use the same. Variations of the preferred embodiment are possible without being outside the scope of the present invention. For example, the horizontal top surface 30 of the draft arm 20 may be open above the center plate and other sections of the draft arm for even further reduction in weight of the draft arm. Therefore, to particularly point out and distinctly claim the subject matter regarded as the invention, the following claims conclude the specification.

What is claimed is:

1. A cast draft arm of relatively light weight construction for a railway car to be located between a center sill and a striker in longitudinal alignment therewith comprising:

a pair of vertical side walls terminating into a pair of lower outwardly extending flanges, a horizontal top surface and a horizontal partially open bottom surface, the horizontal top surface and the horizontal bottom surface both perpendicular to the plane formed by the pair of vertical side walls, a center plate defining a kingpin post and forming a kingpin hole located on the horizontal bottom surface, the kingpin post extending from the center plate into the draft arm and terminating at the plane formed by the horizontal bottom surface, and at least one support member formed integral with the center plate and the pair of side walls, the support member transversing the pair of vertical side walls, the support member extending to the approximate midpoint between the horizontal top surface and the horizontal bottom surface.

2. The cast draft arm as in claim 1 wherein the at least one support member is a pair of transversely extending support members located on opposite sides of the center plate.

3. The cast draft arm as in claim 1 further comprising a plurality of ribs integral with the kingpin post and center plate.

4. The cast draft arm as in claim 3 wherein the plurality of ribs and the kingpin post form a plurality of pockets in the center plate around the kingpin post.

5. The cast draft arm as in claim 1 wherein the kingpin hole includes an upper cylindrical section defining a diameter and a middle cylindrical section coaxial with and of a smaller diameter than the upper cylindrical section.

6. The cast draft arm as in claim 1 wherein the kingpin hole defines a lower cylindrical section coaxial with and of a larger diameter than the middle cylindrical section.

7. A cast draft arm of relatively light weight construction for a railway car to be located between a center sill and a striker in longitudinal alignment therewith comprising:

a pair of vertical side walls terminating into a pair of lower outwardly extending flanges, a horizontal top surface and a horizontal partially open bottom surface, the horizontal top surface and the horizontal partially open bottom surface both perpendicular to the pair of vertical side walls, a center plate located on the horizontal bottom surface, the center plate defining a center plate inner wall, a plurality of ribs, a kingpin post and a kingpin hole, the plurality of ribs, the center plate inner wall, and the kingpin post forming a plurality of pockets, the kingpin post extending from the center plate into the draft arm and terminating at the plane formed by the horizontal bottom surface, and a pair of support members formed integral with the center plate and the horizontal partially open bottom surface, the pair of support members located on opposite sides of the center plate transversing the pair of vertical side walls.

8. The cast draft arm as in claim 7 wherein the kingpin hole includes an upper cylindrical section defining a diameter and a middle cylindrical section coaxial with and of a smaller diameter than the upper cylindrical section.

9. The cast draft arm as in claim 7 wherein the kingpin hole defines a lower cylindrical section coaxial with and of a larger diameter than the middle cylindrical section.

10. A cast draft arm of relatively light weight construction for a railway car to be located between a center sill and a striker in longitudinal alignment therewith comprising:

a pair of vertical side walls terminating into a pair of lower outwardly extending flanges, a horizontal top surface and a horizontal partially open bottom surface, the horizontal top surface and the horizontal partially open bottom surface both perpendicular to the pair of vertical side walls, a center plate located on the horizontal bottom surface, the center plate defining a center plate inner wall, a plurality of ribs, a kingpin post and a kingpin hole, the plurality of ribs, the center plate inner wall, and the kingpin post forming a plurality of pockets, the kingpin post extending from the center plate into the draft arm and terminating at the plane formed by the horizontal partially open bottom surface, and a pair of support members formed integral with the center plate and the horizontal partially open bottom surface, the pair of support members located on opposite sides of the center plate transversing the pair of vertical side walls, the pair of support members extending outward from the center plate to the approximate midpoint between the horizontal top surface and the horizontal partially open bottom surface.

11. The cast draft arm as in claim 10 wherein the kingpin hole includes an upper cylindrical section defining a diameter and a middle cylindrical section coaxial with and of a smaller diameter than the upper cylindrical section.

12. The cast draft arm as in claim 10 wherein the kingpin hole defines a lower cylindrical section coaxial with and of a larger diameter than the middle cylindrical section.

* * * * *